US005542377A

United States Patent [19]

Gemill et al.

[11] Patent Number: 5,542,377

[45] Date of Patent: Aug. 6, 1996

[54] PORTABLE SINK TABLE FOR DENTAL PROPHYS AND PROCEDURES

[76] Inventors: Roderique S. Gemill, 8684 Bridle Path Ct., Davie, Fla. 33328; Joseph R. Tarulli, 6325 Eaton St., Hollywood, Fla. 33024

[21] Appl. No.: 333,746

[22] Filed: Nov. 3, 1994

Related U.S. Application Data

[63] Continuation of Ser. No. 970,688, Nov. 4, 1992, abandoned.

[51] Int. Cl.[6] ..... A61D 3/00

[52] U.S. Cl. ..... 119/753

[58] Field of Search ..... 119/17, 753, 754, 119/757

[56] References Cited

U.S. PATENT DOCUMENTS

| | | | |
|---|---|---|---|
| 561,514 | 6/1896 | Lichtenstein | 5/606 |
| 1,097,894 | 5/1914 | Thompson | 5/604 X |
| 1,572,096 | 2/1926 | Wagley | 5/606 |
| 2,533,774 | 12/1950 | Delisi et al. | 5/604 |
| 2,897,973 | 8/1959 | Sizemore | 108/24 |
| 4,257,349 | 3/1981 | Carlin | 119/753 X |
| 4,367,694 | 1/1983 | Goyheneix | 119/17 |
| 4,471,720 | 9/1984 | Hedeson et al. | 119/17 |
| 4,620,333 | 11/1986 | Ritter | 5/606 X |
| 5,060,580 | 10/1991 | Shaw | 108/25 |

OTHER PUBLICATIONS

J. A. Webster, Inc. Catalog 1992, p. 214.

*Primary Examiner*—Thomas Price
*Attorney, Agent, or Firm*—Herbert L. Lerner; Laurence A. Greenberg

[57] ABSTRACT

A portable sink table structure is disclosed which is adapted for use by veterinarians performing various dental and surgical and other procedures on an animal placed on top of the sink table. The sink table includes a top surface having a solid portion and a grated portion. The solid portion being adapted to fit thereon the body of the animal being treated while the grated portion is adapted to fit thereon the head of the animal being treated. The grated portion includes a removable grate or grill as well as a removable sink member with the latter fitting within a cut-out in the top surface of the sink table. The sink table is adapted to be fitted on top of any convenient horizontal surface such as a veterinarian's standard examination table.

10 Claims, 2 Drawing Sheets

FIG. 1
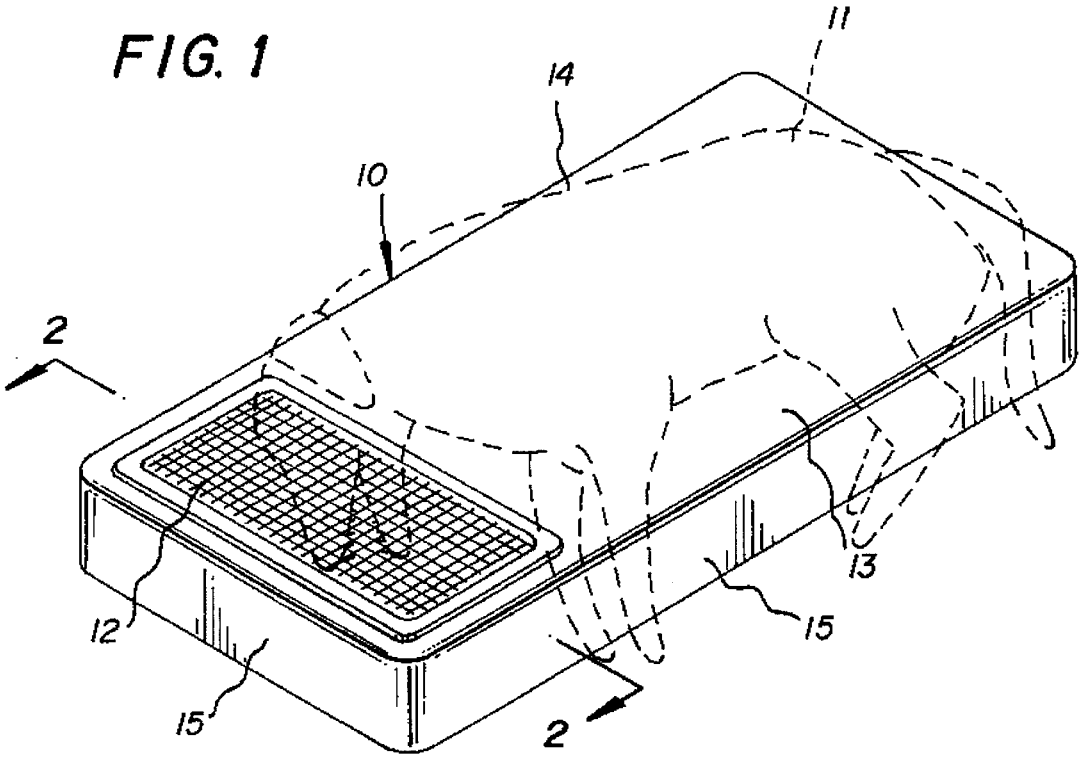
FIG. 2
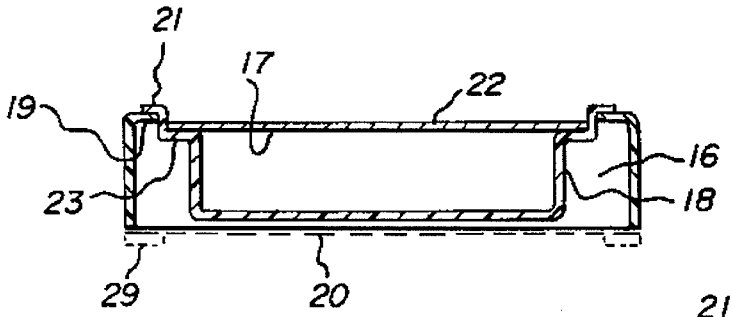
FIG. 2A
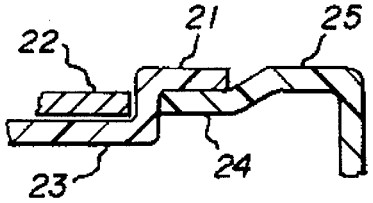
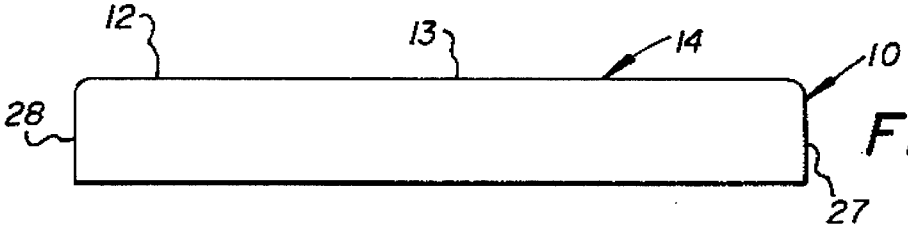
FIG. 3

PORTABLE SINK TABLE FOR DENTAL PROPHYS AND PROCEDURES

This application is a continuation of application Ser. No 07/970,688, filed Nov. 4, 1992, now abandoned.

BACKGROUND OF THE INVENTION

1. Field of the Invention

This invention pertains in general to the field of veterinary medicine surgical apparatus and in particular to the field of a dental prophys and procedures table for use by doctors of veterinary medicine and staff when performing dental prophys and other procedures on various animals.

2. Description of the Prior Art

In the field of veterinary medicine, there is a line of equipment commonly known as treatment tables which are used by veterinarians for various treatments of animals thereon. Such treatment tables are alternatively known as tub-tables. In either event, the apparatus usually comprises a generally non-movable table having a height which is convenient to veterinarians when treating the animals. The upper part of such tub-tables include a tub portion which comprises an elongated tub member which is capable of holding a significant amount of water. In some instances the tub may be six (6) inches deep while in other instances the tub may be as much as sixteen (16) inches deep. A steel wire grill top is provided on the top of the tub member which extends over the entire length and breath of the tub member. The steel wire grill top permits a veterinarian to place an animal thereon and while performing various treatments to the animal, who is usually sedated, any fluids from such treatments or even from the animal pass through the wire grill top and into the tub where they are retained. Such tub-tables then provide a veterinarian with a working surface for the treatment of animals and which provides for the drainage of any treatment fluids away from the animal into the tub member. Obviously, such apparatus is well suited to the treatment of animals wherein treatment fluids or bodily fluids are immediately drained away from the animal and away from the veterinarian so as to negate any possible problems or inconveniences associated therewith.

To further enhance the usability of such prior art tub-tables, some of the more expensive models are provided with a water faucet with on and off handles and a water drain. The water from such faucets may be used during the treatment procedures so as to wash any item which may have become soiled during the treatment, and further to clean the tub portion of the treatment table after the surgical procedure with the waste water supply going down the built in drain.

While such prior art tub tables are quite suited to perform the function which they are intended to perform, there are a number of disadvantages associated with such prior art tub tables. One disadvantage is the permanent nature of the tub tables. In other words, the tub-tables are intended to be permanent fixtures and indeed are so. But this means that the space that the tub-tables occupy cannot be used for any other purpose. When not in use, therefore the tub table becomes an in the way piece of equipment.

Another disadvantage of the prior art tub-tables is that they are in fact not easily cleaned during or after the treatment or procedure being conducted thereon. Because the tub is directly beneath the animal being treated, any fluid or debris which drains into the tub generally stays there until the treatment procedure is finished and the animal is removed and the tub-table is then cleaned. Cleaning of the prior art tub-tables during the treatment procedure is extremely difficult if not impossible.

Cost is yet another disadvantage of the prior art tub tables. Because of the permanent nature of the apparatus, the tub tables tend to be made from stainless steel because of its nonrusting capabilities and its ability to maintain a polished appearance even years after it is first put into use. But, stainless steel is expensive. Typically, the cost of stainless steel tub tables is in the vicinity of two thousand to three thousand dollars.

Accordingly, a primary objective of the present invention is to provide a sink table upon which animals may be placed for treatment by veterinarians thereon which table is inexpensive but yet well suited to the task for which it is intended.

Another objective of the present invention is to provide a sink table for use by veterinarians which is portable and does not take up valuable permanent space within the veterinarian's office.

Yet another objective of the present invention is to provide a sink table for the placement of animals thereon during treatment by veterinarians which table is particularly adapted for dental prophys and dental procedures by a veterinarian.

Another object of the present invention is to provide a sink table for use for the placement of an animal thereon during treatment procedures by a veterinarian which table is capable of being easily cleaned during the treatment procedures or after the treatment procedures.

Another object of the present invention is to provide a sink table for the placement of animals thereon during the treatment thereof by veterinarians which table is configured to prevent fluids used during the treatment procedure to flow back down the throat of the animal causing possible asphyxiation, or aspiration of the fluids.

The above stated objects as well as others which although are not specifically stated, but are intended to be included within the scope and breath of the present invention, are accomplished by the present invention and will become apparent of the hereinafter set forth detailed subscription of the invention, drawings and the claims appended herewith.

SUMMARY OF THE INVENTION

The present invention, in accomplishing the above-stated objectives as well as others, comprises a portable sink table having a size making it capable of being placed upon a veterinarian's standard examination table and then be used by the veterinarian for various dental prophys and dental procedures.

In accordance with the present invention, there is provided a molded elongated box like member having a top and four downwardly extended sides. One end of the box like member is provided with a cut-out extending across the width of the box like member and along the length for an approximate equal distance. Another, but an inverted box like member is provided within the cut-out and supported therein by a flange extending around the inverted boxed like member. A mesh grill member is then provided across the top of the inverted box like member. Thus, the present inventive sink table is adapted to have the head of an animal placed on the grill mesh member while the body of the same is supported by the remaining surface of the box like member. According to the present invention, therefore, only the head of the animal is provided with a sink member thereunder to contain therein any fluids used by the veterinarian during the treatment procedures. If it is desirable to clean the sink member during the treatment procedure it is a simple task to hold up the head of the animal while removing the sink member and replacing the same with a spare clean sink or the original sink after it is clean. Cleaning up the entire sink table is also an easy task after the treatment procedure is finished by simply removing the animal from the same and placing the sink table in a standard laundry sink and thereby cleaning the same.

In one embodiment of the present invention, the horizontal surface of the sink table lies flat in an approximate horizontal plane. In another embodiment of the present invention, the horizontal surface of the sink table is downwardly sloped in a direction extending from one end thereof to the opposite end containing the sink container. In a third embodiment of the present invention, the portion of the table not containing the mesh grill lies in a substantially horizontal plane, while the mesh grill portion extending therefrom extends in a downwardly sloped direction toward the end thereof. In operation the downwardly sloped surface provides a means for the veterinarian to incline the animals' head in a downwardly direction such that any fluids drain away from rather that into the throat of the animal during the treatment procedure.

BRIEF DESCRIPTION OF THE DRAWINGS

Various other objects, advantages, and features of the present invention will become apparent to those skilled in the art from the following discussion taken in conjunction with the following drawings, in which:

FIG. 1 is an isometric view of one embodiment of the present invention illustrating the sink table having one end portion thereof equipped with a mesh grill, while the remaining other portion comprises a substantially horizontal surface:

FIG. 2 is a cross-sectional view, slightly enlarged, of a view taken through the line 2—2 of the sink portion of the embodiment of FIG. 1:

FIG. 2A is a partial cross-section depicting an alternative embodiment of the rim design of FIG. 2;

FIG. 3 is a side profile view of one embodiment of a sink table according to the present invention;

DESCRIPTION OF THE PREFERRED EMBODIMENTS

Figure 4:
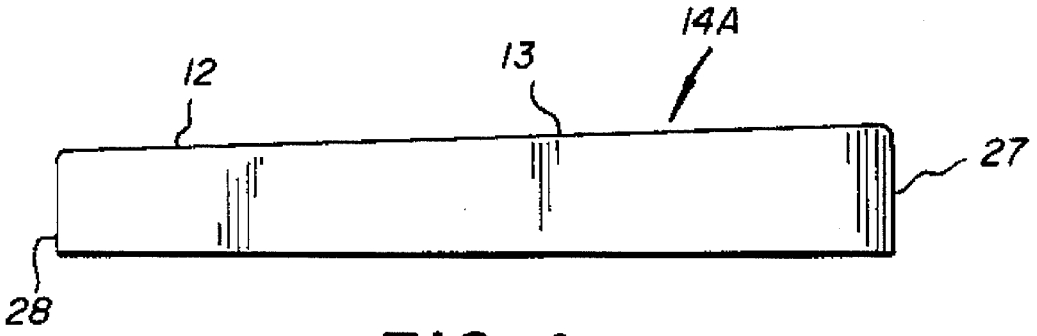
FIG. 4 is a side profile view of another embodiment of a sink table according to the present invention; and, FIG. 5 is a side profile view of yet another embodiment of a sink table according to the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Reference is now made specifically to FIGS. 1 and 2 of the drawings, which taken together substantially depict and illustrate the sink table 10 disclosed herein. It is to be noted at this time that the inventive sink table 10 is intended to be used with an animal placed on top of the sink table for purposes of allowing a veterinarian to perform various dental prophys and other dental procedures on the animal. The invention however, is not to be limited to use for dental procedures. The inventive sink table 10 may also be used by a veterinarian for various other procedures such as surgical procedures carried out on the body of the animal placed on the top of the sink table 10.

In FIG. 1 of the drawings, the outline of an animal 11 is shown in phanthom resting on its side on top of the sink table 10. The animal 11 is shown to be relatively large compared to the size of the inventive sink table 10. It is however, to be understood that a much smaller animal may be utilized with the sink table 10. Of particular importance is the fact that the animal 11 is positioned in such that its head is placed substantially over a grated portion 12 of the sink table 10. Such positioning including the advantages thereof will be better understood as further explained in this specification.

The body of the animal 11 is seen to be positioned over a flat or non grated portion 13 of the sink table 10. It is to be further noted at this time that the animal 11 is under sedation at the time it is positioned on the top of sink table 10.

The main body of sink table 10 comprises a box or shell like structure having a top surface 14 and four downwardly extending sides 15. The underside of the main body portion of the sink table 10 is seen in FIG. 2 to be hollow. Thus, the main body portion of the sink table 10 may be fabricated from a suitable plastic or fiberglass material which is capable of being laid up upon a male mold or pattern form or may be injected molded using an appropriate male or female dye. Since the sink table 10 is intended to be used with even relatively large domestic animals the thickness of the top 14 and sides 15 of the sink table 10 should be sufficiently thick so as to adequately support a large animal without excess elastic distortion or deformation.

A rectangular or squared cut-out 17 is provided within the grated portion 12 of the sink table 10. Cut-out 17 is intended to accept a tray or sink structure 18 therein. Sink structure 18 is configured to be supported by the edge 19 surrounding the cut-out 17 in the body portion of sink tub 10. Accordingly, the rim portion 21 of sink structure 18 may be alternatively configured as shown in FIGS. 2 and **2*a*** of the drawings.

In FIG. 2, the rims 19 surrounding cut-out 17 are perfectly or substantially flat. And since sink structure 18 is also configured to fit within the perimeter thereof, a grate or grill drain 22, a ledge or step 23 must also be provided around the perimeter or peripheral edges 29 of sink structure 18. In this manner, the grill or grate 22 may be positioned to lie in substantially the same plane as the edges 19 of the sink table 10. The peripheral edges 29 of the sink structure 18 would however in this instance lie slightly above the top surface of the edges 19 by the thickness of the edges 29 of sink structure 18. This configuration would be advantageous in that the entire top surface of the sink table 10 would lie in a substantially single plane with the exception of the slight protrusion caused by edges 29 around the sink structure 18. This configuration would also be advantageous in that the slight protrusion caused by the edges 29 of sink structure 18 would allow a veterinarian or other operating personnel or assisting personnel to relatively easily grasp the sink structure 18 by the edges 29 and remove the same from the body of the sink table 10.

The alternative rim design of cut-out 17 and sink structure 18 shown in FIG. 2*a* of the drawings. In this example, it is seen that a downward step 24 is provided in the peripheral edges or rim of the cut-out 17. Step 24 then allows for a flush fit with the peripheral edge 29 of sink structure 18. Moreover, the stepped ledge 23 of sink structure 18 may then be configured to fit the grate or grill 22 there within and yet provide a flush fit between the top of grate 22, the top of the peripheral edge 29 of the sink 18 and the top of the ridged peripheral edge 25 of the body portion of sink table 10 immediately surrounding sink structure 18. A slight disadvantage of this configuration is that it is somewhat more difficult to attempt to remove sink structure 18 from the sink table 10 when it is desired to clean the sink structure 18.

Figure 5:
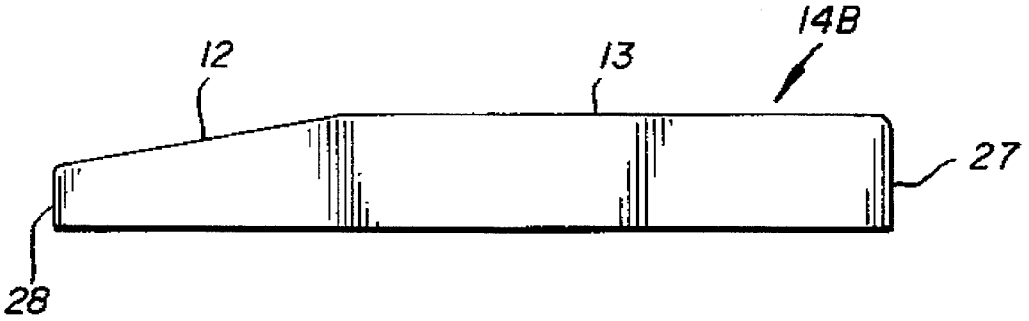
Figure 6:
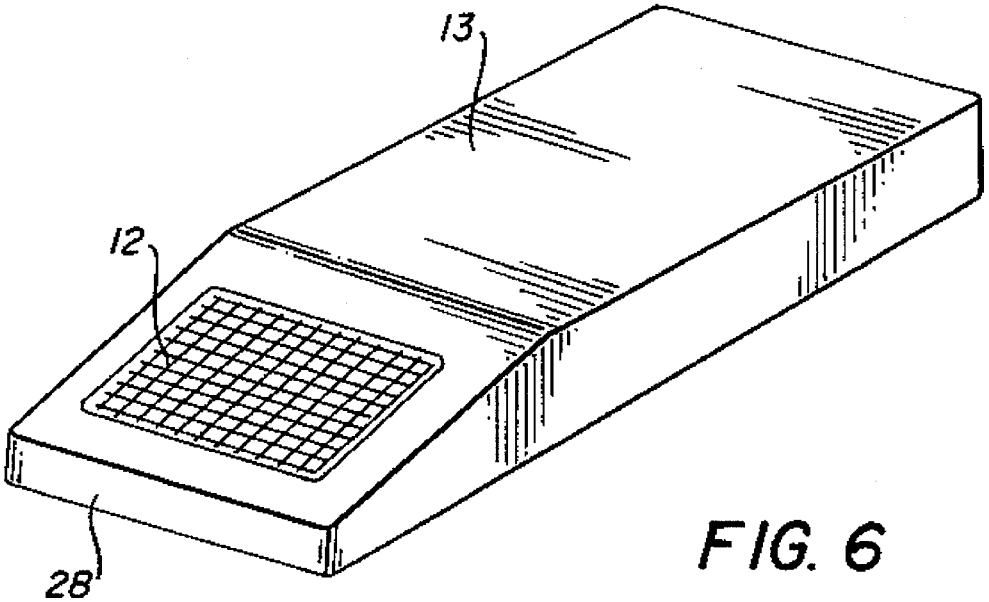
FIG. 6 is a perspective view of FIG. 5.

The various side profiles according to the present invention of the inventive sink table 10 are shown in FIGS. 3,4 and 5 of the drawings. FIG. 3 illustrates that the top surface 14 of the nongrated portion 13 of sink table 10 lies in a substantially straight horizontal plane. In this regard, the top surface of grate 22 also lies in the same substantially flat plane encompassing top surface 14.

In FIG. 4, the top surface 14*a* of the nongrated portion 13 of sink table 10 slants downwardly from the end of the nongrated portion 13 toward the end 28 at grated portion 12 of the sink table 10. In this regard, the slanted plane of the grate 22 would also lie in the slanted plane of surface 14*a*.

In FIG. 5 of the drawings, it is seen that the solid portion 13 of the body of the sink table 10 lies in a substantially horizontal plane while the grate portion 12 of surface 14*b* slants in a downwardly direction beginning at the aft edge 27 of grate portion 12 toward the end 28 of the grate portion 12 of the sink table 10.

In practice, the flat top surface 14 of the embodiment of FIG. 3 would place the head of the animal being treated in substantially the same horizontal position as the body of the animal. This is somewhat disadvantageous in that fluid entering the throat of the animal might proceed in a backward direction toward the throat of the animal rather that through the grate 22 and into the sink structure 18. In this regard, however it is possible for veterinarians to position the animal's head in a downwardly inclined direction by the use of a towel under the neck portion of the animal. In the embodiment of FIGS. 4 & 5, the head of the animal is automatically positioned in a downwardly inclined direction such that any fluids entering through the mouth of the animal 11 would not proceed in a direction down his throat but rather in a direction toward and through the grate 22 into the sink structure 18.

The embodiment of FIG. 4 has an additional advantage over the other embodiments in that the constantly inclined surface 14*a* prevents any puddling of any fluids underneath the body of the animal during the treatment of the same. Such fluids would of course tend to flow toward the grate portion 12 and through the grate 22 into the sink structure 18.

In a further embodiment, the inventive sink table 10 includes a bottom member 20 which is shown in phantom is FIG. 2 bottom member 20 extends across the entire width and length of sink table 10, and is attached to side members 15 thereby forming a hollow box structure. A plurality of non-skid feet 29 may be provided on the underside of bottom member 20. A hollow box structure provides for a high degree of stiffness and strength while allowing for the use of thin structural walls. A hollow box structure also provides for storage of the basin 18 and grate 22 there within when the sink table 10 is not in use.

In order to use the inventive sink table 10, it is merely necessary to remove sink table 10 from an appropriate storage location and place it onto the top of a veterinarian's examination table which examination tables are substantially a standard fixture within the office of any veterinarian. Thus, the inventive sink table 10 eliminates the need of a veterinarian to have a permanent tub table installed within his offices in order to conduct various surgical and dental procedures on an animal.

Once the sink table 10 is in position on an examining table, it is then possible to place an animal on the top surface 14 and then administer an anesthetic to cause unconsciousness in the animal to permit the dental or surgical procedures to take place. The location of the sink table 10 as well as the positioning of the animal thereon, allows the use of standard anesthetic administering machinery including the tubes connected thereto to supply both an anesthetic and oxygen to an animal to be used in conjunction with the sink table 10. While the animal 11 is thus unconscious, a veterinarian or other appropriate technician may for example perform or dental prophy on the animal. Any fluid or water emitted from the prophy cleaning apparatus, which is commonly used to cool the teeth of the animal during the procedure, would simply flow not into the throat of the animal but rather through the grate 22 into the sink structure 18. Should the sink structure 18 become filled during the procedure to the extent that it is desirable to empty the same, all that is necessary is to lift the head of the animal and remove the sink structure including the grate 22 from the body of the sink table 10. The sink structure 18 may then be drained of its contents, be cleaned and then replaced under the animal's head within the body of the sink table 10.

Upon completion of the dental or surgical procedure upon an animal 11 placed on top of the sink table 10, the animal 11 may be removed therefrom and thus allow a person to remove the entire sink table 10 from the top of the surface structure on which it is resting, remove the sink structure for separate cleaning purposes and after cleaning of the body portion of the sink table 10, replace the sink structure and store the sink table 10 in an appropriate place.

It is to be noted, that it is not necessary for the inventive sink table 10 to be utilized with a standard examination table of a veterinarian, but rather may be used in conjunction with any appropriate flat surface in an area where the procedure is to take place. Also, it is not necessary that a source of cleaning water or other fluid be necessarily adjacent to or close to the site where the sink table is to be located. And, since the inventive sink table 10 is portable, a veterinarian or other appropriate person may even if it is required to transport the sink table 10 to the location of the animal to be treated which may be out of the office of the veterinarian, with relative ease.

While the invention has been described, disclosed, illustrated and shown in certain terms or certain embodiments or modifications which it has assumed in practice, the scope of the invention is not intended to be nor should it be deemed to be limited thereby and such other modifications or embodiments and may be suggested by the teachings herein are particularly reserved especially as they fall within the breath and scope of the claims here appended.

We claim as our invention:

1. A portable sink table to be used for dental surgical or other procedures on an animal by a veterinarian comprising:

a main body structure having a top surface configuration including a solid portion and a grated portion, said top surface having side members and extending downward therefrom such that said body structure comprises a hollow member, said solid portion having a length greater than the length of said grated portion, said grated portion being adapted to fit thereon the head of the animal being treated while the solid portion is adapted to support thereon the body of the animal being treated, said portable sink table being proportioned to be removably placed on a veterinarian's examination table whereby the portable sink table may be used for dental, surgical or other veterinarian procedures and thereafter be removed and placed aside during periods of non use, at least said grated portion of said top surface substantially lying in an inclined plane which is inclined in a downward direction from an end of said solid portion towards said grated portion relative to a horizontal defined by the veterinarian's examination table.

2. The portable sink of claim 1 including a bottom member extending across a length and width of said body structure.

3. The portable sink of claim 2 including a plurality of non-skid foot members on a bottom surface of said bottom member.

4. The portable sink table of claim 1 wherein said gratted portion includes a sink member fitting within a cut-out in the top surface of the body structure of the sink table and a grate member fitted to said sink member.

5. The portable sink table of claim 4 wherein said sink member is removably positioned within said cut-out in said main body structure.

6. The portable sink table of claim 5 wherein said grate member is removably positioned on a ledge extending around the periphery of said sink member.

7. The portable sink table of claim 4 wherein in said sink member includes an outer peripheral ledge and an inner peripheral ledge extending around the periphery of said sink member which said inner peripheral ledge being stepped down from said outer peripheral ledge.

8. The portable sink table of claim 4 wherein the cut-out within said top surface includes a stepped down ledge extending around the periphery of said cut-out relative to the top surface surrounding said peripheral ledge.

9. A portable sink table for dental, surgical or other procedures on an animal by a veterinarian, comprising:

a main body structure having a given width and a top surface including a substantially solid portion said portions extending about said width and a grated portion;

said grated portion being adapted to fit thereon a head of an animal being treated and said solid portion being adapted to support thereon the body of the animal being treated;

said main body structure having a hollow space defined therein for receiving fluids from the head of the animal being treated, said hollow space being upwardly bounded by a grate member of said grated portion; and said main body structure being adapted to be supported on a substantially horizontal support surface and said grated portion being inclined in a downward direction away from said solid portion.

10. The portable sink table according to claim 9, wherein said solid portion of said main body structure is inclined in a direction towards said grated portion.

* * * * *